United States Patent [19]

Tawa et al.

[11] 4,163,308

[45] Aug. 7, 1979

[54] DEFLECTION YOKE ASSEMBLY POSITIONING DEVICE

[75] Inventors: Tutomu Tawa, Yokohama; Hiroshi Furukawa, Kamakura, both of Japan

[73] Assignee: Hitachi, Ltd., Tokyo, Japan

[21] Appl. No.: 884,238

[22] Filed: Mar. 7, 1978

[30] Foreign Application Priority Data

Jun. 24, 1977 [JP] Japan ..... 52-74344
Jul. 25, 1977 [JP] Japan ..... 52-88387

[51] Int. Cl.[2] ..... H01J 9/44
[52] U.S. Cl. ..... 29/25.19; 316/27
[58] Field of Search ..... 29/25.19, 25.2; 316/1, 316/23, 27, 29; 324/20 CR

[56] References Cited

U.S. PATENT DOCUMENTS

| | | | |
|---|---|---|---|
| 2,924,190 | 2/1960 | Greiner et al. | 29/25.19 |
| 3,369,201 | 2/1968 | Fiore et al. | 324/20 |
| 3,617,871 | 11/1971 | Rogus et al. | 324/20 |

*Primary Examiner*—Richard B. Lazarus
*Attorney, Agent, or Firm*—Craig & Antonelli

[57] ABSTRACT

A deflection yoke assembly positioning device which grasps the opening portion of flared portion of a deflection yoke assembly mounted on the funnel yoke portion of a color cathode-ray tube of a color television receiver in the steps of correction of inclination of the display screen, purity adjustment and convergence alignment. The device positions the deflection yoke assembly in the most desired position on the funnel yoke portion of the cathode-ray tube by causing rotating movement of the deflection yoke assembly around its axis, sliding movement of the deflection yoke assembly in the axial direction of the neck portion of the cathode-ray tube, and vertical and horizontal oscillating movement of the opening portion of the deflection yoke assembly relative to the axis of the neck portion of the cathode-ray tube.

4 Claims, 13 Drawing Figures

DEFLECTION YOKE ASSEMBLY POSITIONING DEVICE

This invention relates to a color cathode-ray tube of a color television receiver, and more particularly to a device used for positioning a deflection yoke assembly by moving it in required directions relative to the color cathode-ray tube for the purposes of correction of inclination of the display screen, colorimetric purity adjustment, convergence alignment, etc. of the color cathode-ray tube.

The assembling process for a color television receiver includes the steps of correction of inclination of the display screen of a color cathode-ray tube (referred to hereinafter merely as a cathode-ray tube), adjustment of (colorimetric) purity in the peripheral area of the display screen, convergence alignment in the peripheral area of the display screen, etc. In these steps of screen inclination correction, purity adjustment and convergence alignment, the deflection yoke assembly mounted on the funnel yoke portion of the cathode-ray tube is rotated around its axis or slided in the direction of the axis of neck portion of the cathode-ray tube, or the opening portion or flared portion of the deflection yoke assembly is adjustably moved around the center or its fixing portion in the directions vertical and horizontal with respect to the axis of the neck portion of the cathode-ray tube.

In the above steps of the assembling process, the opening portion of the deflection yoke assembly mounted on the funnel yoke portion of the cathode-ray has been grasped by the hands of the operator, and while observing a test pattern displayed on the display screen of the cathode-ray tube, the operator has suitably rotated, slided and oscillated the deflection yoke assembly relative to the cathode-tube so as to set the screen inclination, purity adjustment and convergence alignment in their best conditions. When the best conditions of screen inclination, purity adjustment and convergence alignment have been attained, the operator has driven a plurality of wedge-shaped members in predetermined circumferentially spaced apart relation into the gap between the funnel yoke portion of the cathode-ray tube and the opening portion of the deflected yoke assembly to securely fix the deflection yoke assembly on the funnel yoke portion of the cathode-ray tube.

In the prior art manner of screen inclination correction, purity adjustment and convergence alignment, however, the operator must grasp the opening portion of the deflection yoke assembly by his hands so as to position the deflection yoke assembly in the required position on the cathode-ray tube. Therefore, a small change occurs in the attitude of the deflection yoke assembly each time the deflection yoke assembly is moved by the hands of the operator, and fine adjustment must be done whenever the deflection yoke assembly is moved so that it can be maintained in its most desired attitude, resulting in an extended assembling time and low assembling efficiency. Further, when the wedge-shaped members are driven into the gap between the funnel yoke portion of the cathode-ray tube and the opening portion of the deflection yoke assembly to securely fix the deflection yoke assembly on the cathode-ray tube, a non-uniform force tending to shift the deflection yoke assembly may be imparted to the deflection yoke assembly, and it may not be fixed in the most desired position on the cathode-ray tube. Furthermore, grasping of the deflection yoke assembly by the hands of the operator is very dangerous since a very high voltage is applied to the deflection yoke assembly to display the test pattern on the display screen of the cathode-ray tube. Moreover, the manual handling by the operator for the purposes of screen inclination correction, purity adjustment and convergence alignment is deflective in that it provides an obstacle against automation of the assembling process for color television receivers.

It is therefore a primary object of the present invention to provide a device for mechanically positioning the deflection yoke assembly on the cathode-ray tube so that the steps of screen inclination correction, purity adjustment and convergence alignment in the color television receiver assembling process can be automatically carried out.

Another object of the present invention is to provide a deflection yoke assembly positioning device which grasps the opening portion of the deflection yoke assembly and causes rotating movement, sliding movement and oscillating movement of the deflection yoke assembly around the center of its fixing portion and along the axis of the neck portion of the cathode-ray tube so as to position the deflection yoke assembly in the required position on the cathode-ray tube.

The deflection yoke assembly positioning device according to the present invention which attains the above objects is featured by the fact that a plurality of freely rotatable rollers are used to grasp the opening portion of a deflection yoke assembly mounted on the funnel yoke portion of a cathode-ray tube, and then, independent drive sources are actuated to cause controlled rotating movement of the deflection yoke assembly around its axis, controlled sliding movement of the deflection yoke assembly in the direction of the axis of the neck portion of the cathode-ray tube, and controlled oscillating movement of the opening portion of the deflection yoke assembly in the directions horizontal and vertical with respect to the center of its fixing portion, respectively, without any interference between these movements, so as to make correction of inclination of the display screen of the cathode-ray tube, adjustment of purity in the peripheral area of the display screen, and convergence alignment in the peripheral area of the display screen, thereby positioning the deflection yoke assembly in the required position on the cathode-ray tube.

In accordance with the present invention, there is provided a device for positioning a deflection yoke assembly on a cathode-ray tube comprising:

(a) first oscillating means comprising grasping means including a plurality of rollers for rotatably grasping the deflection yoke assembly in such a relation that the center of the fixing portion of the deflection yoke assembly is located on a horizontal axis, and causing controlled vertical oscillating movement of the opening portion of the deflection yoke assembly around the center of the fixing portion;

(b) rotating means associated with the first oscillating means for causing controlled rotating movement of the deflection yoke assembly grasped by the first oscillating means around the axis of the deflection yoke assembly;

(c) second oscillating means for supporting the first oscillating means in such a relation that the center of the fixing portion of the deflection yoke assembly grasped by the first oscillating means is located on a vertical axis, and turning the first oscillating means around the vertical axis thereby causing controlled horizontal oscillating movement of the opening portion of the deflection yoke assembly around the center of the fixing portion; and (d) sliding means carrying the second oscillating means thereon for causing controlled sliding movement of the second oscillating means in the axial direction of the neck portion of the cathode-ray tube thereby causing controlled sliding movement of the deflection yoke assembly grasped by the first oscillating means in the axial direction of the neck portion of the cathode-ray tube.

Other objects, features and advantages of the present invention will become more apparent from the following detailed description of a preferred embodiment thereof taken in conjunction with the accompanying drawings, in which.

Figure 6A:
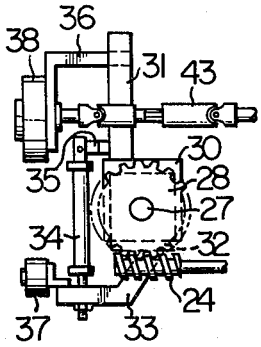
Figure 6B:
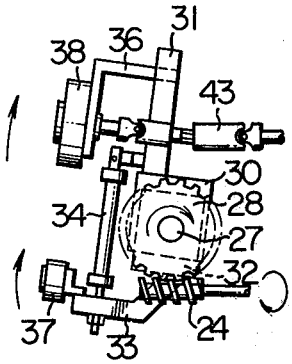
Figure 6C:
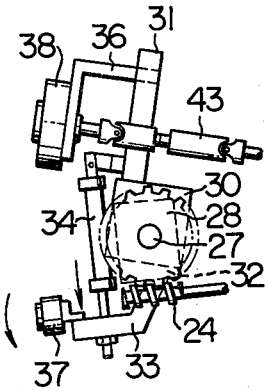
Figure 6D:
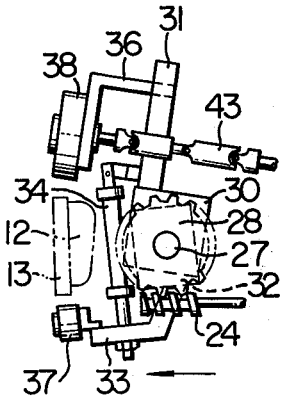
Figure 6E:
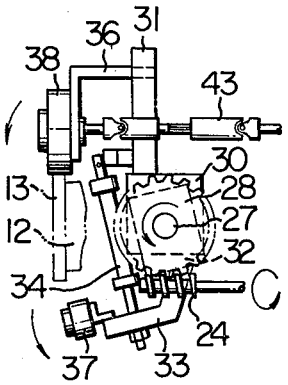
Figure 6F:
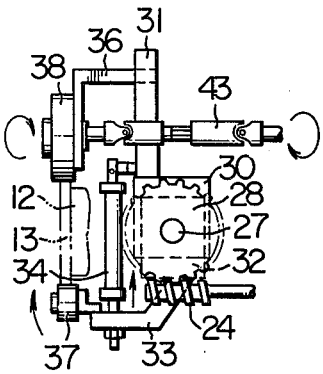
Figure 7:
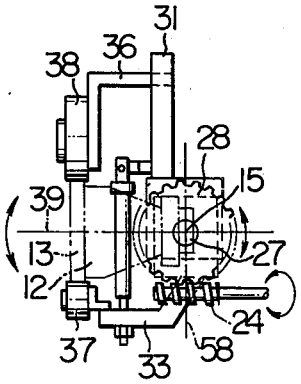
Figure 8:
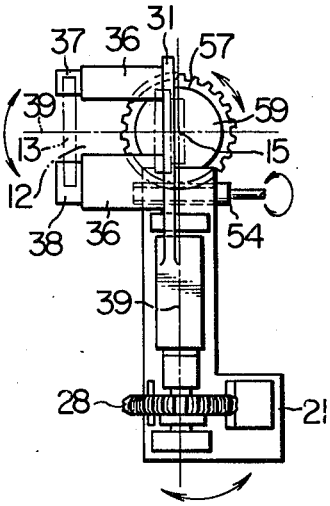

FIG. 6*a* is a schematic side elevational view of part of a first oscillating unit before grasping the deflection yoke assembly;

FIG. 6*b* is a view similar to FIG. 6*a*, but showing the partly opened state of the grasping section of the first oscillating unit;

FIG. 6*c* is a view similar to FIG. 6*b*, but showing the completely opened state of the grasping section of the first oscillating unit;

FIG. 6*d* is a view similar to FIG. 6*c*, but showing the state of insertion of the deflection yoke assembly in the grasping section of the first oscillating unit;

FIG. 6*e* is a view similar to FIG. 6*d*, but showing the state of grasping the deflection yoke assembly by the grasping section of the first oscillating unit;

FIG. 6*f* is a view similar to FIG. 6*e*, but showing the grasped state of the deflection yoke assembly by the grasping section of the first oscillating unit;

FIG. 7 is a schematic side elevational view of part of the device to show how the deflection yoke assembly is oscillated in the vertical direction by the first oscillating unit; and FIG. 8 is a schematic side elevational view of part of the device to show how the deflection yoke assembly is oscillated in the horizontal direction by a second oscillating unit.

A preferred embodiment of the deflection yoke assembly positioning device according to the present invention will now be described in detail with reference to the drawings.

Figure 1:
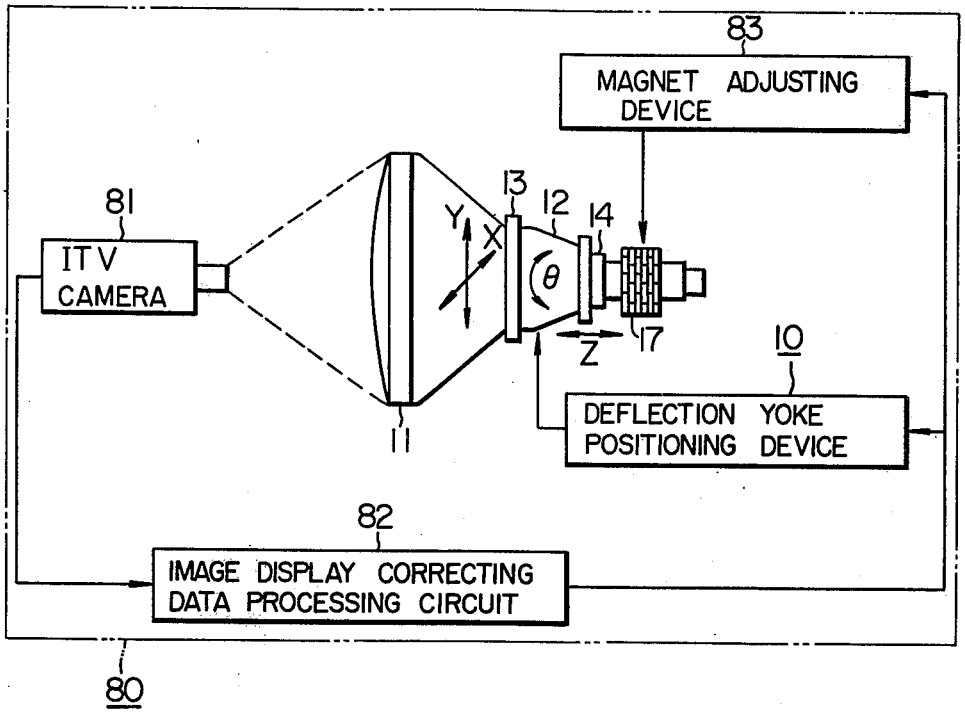
FIG. 1 is a block diagram of an image display correcting system using an embodiment of the deflection yoke assembly positioning device according to the present invention.
Figure 2:
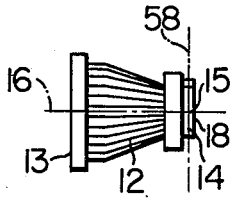
FIG. 2 is a schematic side elevational view of a deflection yoke assembly.
Figure 3:
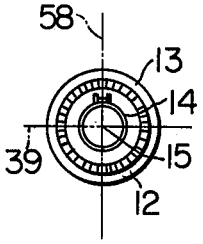
FIG. 3 is a schematic rear view of the deflection yoke assembly shown in FIG. 2.

Referring to FIGS. 1 to 3, a deflection yoke assembly 12 mounted on the funnel yoke portion of a cathode-ray tube 11 is formed at one end thereof with an opening portion 13 and at the other end thereof with a fixing portion 18 having a fixing member 14. The center 15 of the fixing portion 18 lies on the axis 16 of the deflection yoke assembly 12 and also on the axis of the neck portion of the cathode-ray tube 11.

Figure 4:
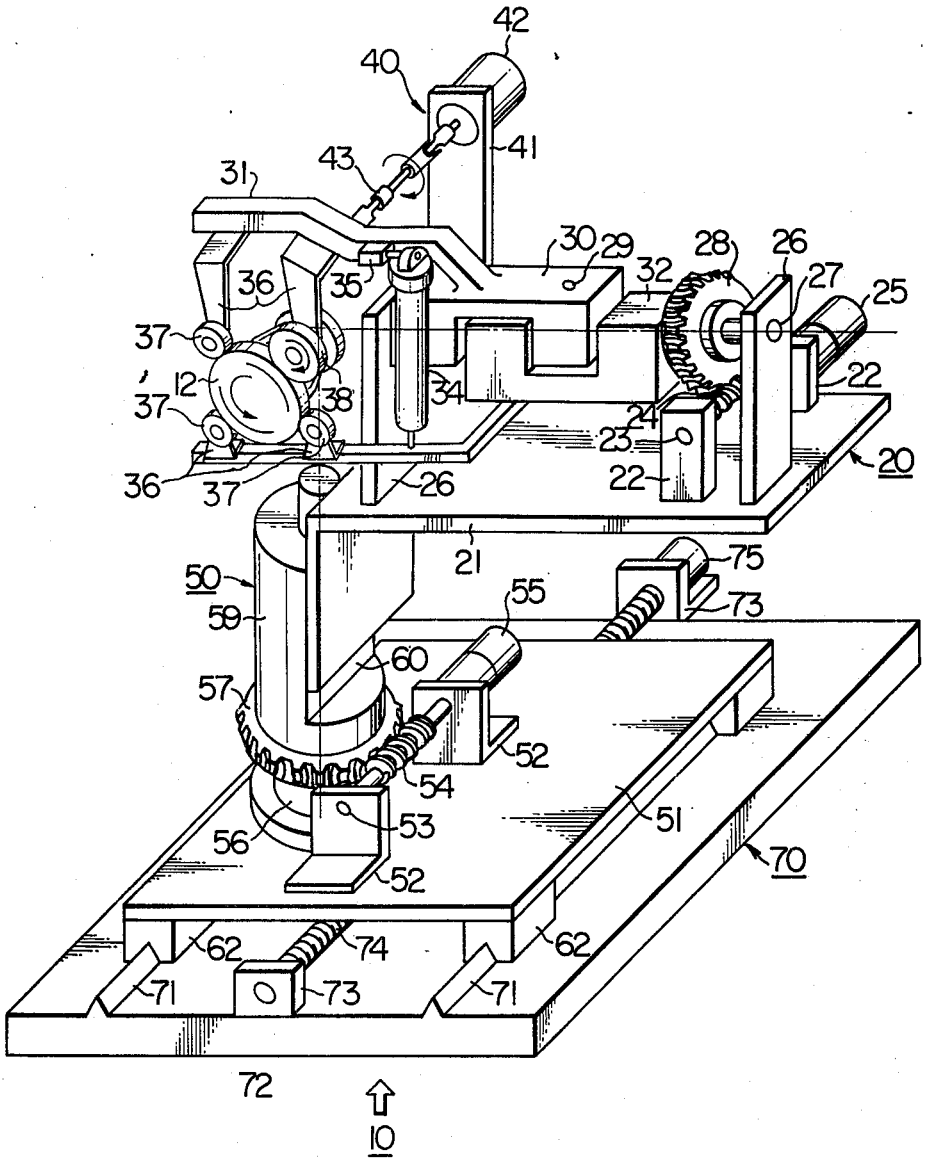
FIG. 4 is a schematic perspective view of an embodiment of the deflection yoke assembly positioning device according to the present invention.
Figure 5:
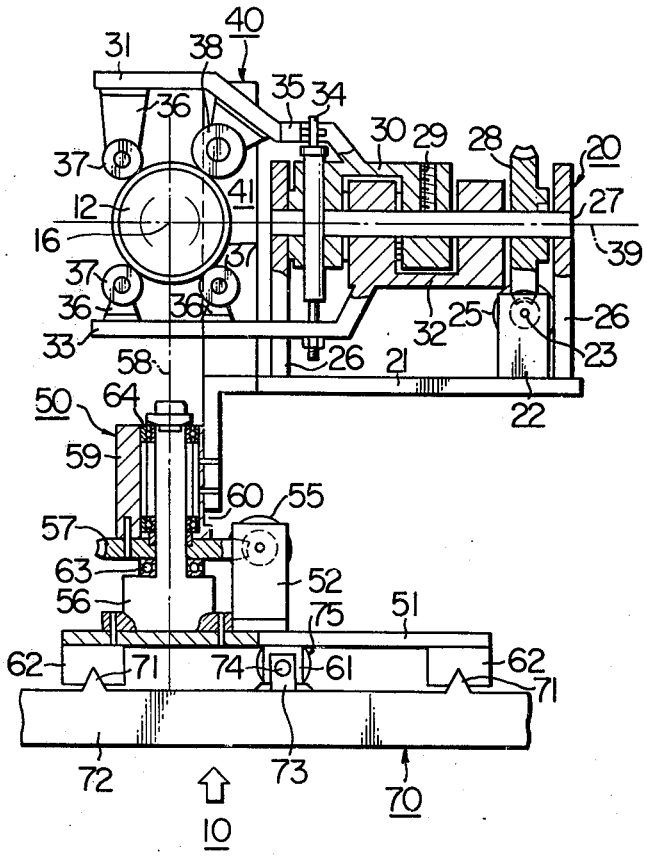
FIG. 5 is a schematic front elevational view, partly in section, of the device shown in FIG. 4.

Referring to FIGS. 4 and 5, an embodiment of the deflection yoke assembly positioning device according to the present invention is designated generally by the reference numeral 10 and comprises a first oscillating unit 20, a rotating unit 40, a second oscillating unit 50, and a sliding unit 70. The first oscillating unit 20 includes a plurality of freely rotatable rollers engageable with the outer peripheral face of the opening portion 13 of the deflection yoke assembly 12 to releasably grasp the deflection yoke assembly 12 at this portion. This first oscillating unit 20 acts to cause controlled oscillating movement of the opening portion 13 of the deflection yoke assembly 12 in the vertical direction around the center 15 of the fixing portion 18. The rotating unit 40 is associated with the first oscillating unit 20 to cause controlled rotating movement of the deflection yoke assembly 12 grasped by the first oscillating unit 20 around the axis 16 of the deflection yoke assembly 12. The second oscillating unit 50 supports the first oscillating unit 20 and acts to turn this first oscillating unit 20 in the horizontal direction around a vertical axis passing the center 15 of the fixing portion 18 of the deflection yoke assembly 12 grasped by the first oscillating unit 20 thereby causing controlled horizontal oscillating movement of the opening portion 13 of the deflection yoke assembly 12 around the center 15 of its fixing portion 18. The sliding unit 70 carries the second oscillating unit 50 thereon and causes controlled sliding movement of this second oscillating unit 50 in the direction of the axis of the neck portion of the cathode-ray tube 11 thereby causing controlled sliding movement of the deflection yoke assembly 12 grasped by the first oscillating unit 20 in the direction of the axis of the neck portion of the cathode-ray tube 11.

As described hereinbefore, the first oscillating unit 20 grasps the deflection yoke assembly 12 by engaging the outer peripheral face of the opening portion 13 thereof to cause controlled oscillating movement of this opening portion 13 in the vertical direction around the center 15 of the fixing portion 18. This first oscillating unit 20 includes a horizontal shaft 27 supported rotatably between a pair of supporting plates 26 fixed to a turning base 21 in a relation spaced apart by a predetermined distance, and a worm wheel 28 is fixedly mounted on this horizontal shaft 27. A supporting member 30 is fixed to this horizontal shaft 27 by a screw 29, and another supporting member 32 is freely rotatably mounted on this horizontal shaft 27. An upper arm 31 and a lower arm 33 extend in a predetermined direction from these supporting members 30 and 32 respectively. An air cylinder 34 (referred to hereinafter merely as a cylinder) is swingably supported at one end thereof at an intermediate portion of the upper arm 31 through a connecting member 35 and is connected at the other end thereof with an intermediate portion of the lower arm 33. Thus, the upper and lower arms 31 and 33 are urged toward and away from each other by the action of the cylinder 34 so that the deflection yoke assembly 12 can be releasably grasped. The grasping section of the first oscillating unit 20 for releasably grasping the deflection yoke assembly 12 includes a driving roller 38 and a grasping roller 37 respectively supported freely rotatably on one end of a pair of brackets 36 fixed at the other end to the upper arm 31, and also a pair of grasping rollers 37 respectively supported freely rotatably on one end of another pair of brackets 36 fixed at the other end to the lower arm 33. The latter rollers 37 are disposed opposite to the former rollers 37 and 38, respectively. These rollers 37 and 38 are arranged so that the center 16 of the deflection yoke assembly 12 is situated on the axis 39 of the horizontal shaft 27 when the deflection yoke assembly 12 is grasped by the rollers 37 and 38. A shaft 23 is supported rotatably between a pair of spaced supporting plates 22 on the turning base 21, and a worm 24 is fixedly mounted on this shaft 23 and meshes with the worm wheel 28 on the shaft 27 to cause rotation of the worm wheel 28, hence, the shaft 27. A motor 25 is coupled to one end of the shaft 23 to cause rotation of this shaft 23.

As described hereinbefore, the rotating unit 40 acts to cause controlled rotating movement of the deflection yoke assembly 12 grasped by the rollers 37 and 38 around the axis 16 of the deflection yoke assembly 12. This rotating unit 40 includes a motor 42 supported by a supporting member 41 fixed to the turning base 21, and a drive shaft 43 having a universal joint with a spline connection for connecting the motor 42 with the driving roller 38. This universal joint is provided for absorbing misalignment of the axes of the roller 38 and the motor 42 or variation of the distance between the roller 38 and the motor 42 which may be caused when the opening portion 13 of the deflection yoke assembly 12 is oscillated in the vertical direction relative to the cathode-ray tube 11.

As described hereinbefore, the second oscillating unit 50 acts to turn the turning base 21, hence, the first oscillating unit 20 in the horizontal direction around the vertical axis passing the center 15 of the fixing portion 18 of the deflection yoke assembly 12 grasped by the first oscillating unit 20 thereby causing controlled horizontal oscillating movement of the opening portion 13 of the deflection yoke assembly 12. This second oscillating unit 50 includes an upstanding shaft 56 fixed vertically to a slide base 51 with the extension of its axis 58 passing the center 15 of the fixing portion 18 of the deflection yoke assembly 12 grasped by the first oscillating unit 20, and a worm wheel 57 supported rotatably on this shaft 56 by means of a bearing 63. A vertical shaft 59 is fixed to this worm wheel 57 with bearings 64 fitted between it and the upstanding shaft 56 so that the vertical shaft 59 can freely rotate around the axis 58 of the shaft 56. This vertical shaft 59 is formed with a cutout 60 in its outer peripheral face, and a depending portion of the turning base 21 is fixed to the cutout 60 of the vertical shaft 59. A shaft 53 is rotatably supported on the slide base 51 by a pair of spaced supporting plates 52, and a worm 54 is fixedly mounted on this shaft 53 and meshes with the worm wheel 57 to rotate the worm wheel 57, hence, the shaft 59. A motor 55 is coupled to one end of the shaft 53 to cause rotation of this shaft 53. A nut 61 is fixed to the lower face of the slide base 51 and meshes with a feed screw 74 described later so as to cause sliding movement of the slide base 51 in the axial direction of the neck portion of the cathode-ray tube 11 in response to the rotation of the feed screw 74. Two pairs of spaced blocks 62 each having a V-shaped groove are also fixed to the lower face of the slide base 51, and each block pair 62 engage with an associated guide 71 described later so as to define the direction of sliding movement of the slide base 51.

As described hereinbefore, the sliding unit 70 acts to cause controlled sliding movement of the slide base 51, hence, the second oscillating unit 50 in the axial direction of the neck portion of the cathode-ray tube 11 thereby causing controlled sliding movement of the deflection yoke assembly 12 grasped by the first oscillating unit 20 in the axial direction of the neck portion of the cathode-ray tube 11. This sliding unit 70 includes a stationary base 72 having formed thereon a pair of parallel guides 71 of inverted-V shape projecting in a relation spaced apart by a predetermined distance therebetween so as to define the direction of sliding movement of the slide base 51 by engaging the associated pairs of the blocks 62 fixed to the lower face of the slide base 51. The sliding unit 70 includes also a feed screw 74 freely rotatably supported on the stationary base 72 by a pair of spaced supporting plates 73 so as to mesh with the nut 61, and a motor 75 is coupled to one end of this feed screw 74 to rotate the same.

Referring to FIG. 1 again, an image display correcting system 80 using the deflection yoke assembly positioning device 10 according to the present invention comprises an ITV camera 81, control means including an image display correcting data processing circuit 82 (referred to hereinafter merely as a procesing circuit), and a magnet adjusting device 83, besides the deflection yoke assembly positioning device 10. The ITV camera 81 monitors a test pattern displayed on the display screen of the cathode-ray tube 11. The processing circuit 82 determines the image display correcting direction by processing the image signal of the test pattern picked up by the ITV camera 81 and applies a sequence of instruction signals to the magnet adjusting device 83 and to the deflection yoke assembly positioning device 10. In response to the application of the instruction signals from the processing circuit 82, the magnet adjusting device 83 acts to suitably rotate the magnets in the magnet assembly 17 mounted on the neck portion of the cathode-ray tube 11 to attain convergence alignment and purity adjustment in the central area of the display screen of the cathode-ray tube 11. In response to the application of the instruction signals from the processing circuit 82, the deflection yoke assembly positioning device 10 acts to cause controlled rotating movement, sliding movement and oscillating movement of the deflection yoke assembly 12 mounted on the funnel yoke portion of the cathode-ray tube 11 in the required directions to attain correction of inclination of the display screen and convergence alignment and purity adjustment in the peripheral area of the display screen of the cathode-ray tube 11.

The operation of the deflection yoke assembly positioning device 10 in the image display correcting system 80 will be described in detail with reference to FIGS. 6*a* to 6*f* and FIGS. 7 and 8.

Referring to FIG. 6*a*, the rollers 37 and 38 are initially situated in their predetermined non-operative positions. Referring to FIG. 6*b*, the motor 25 is driven to cause clockwise swinging movement of the upper and lower arms 31 and 33 through a predetermined angle around the axis 39 of the horizontal shaft 27. Then, as shown in FIG. 6*c*, the cylinder 34 is actuated to cause counter-clockwise swinging movement of the lower arm 33 through a predetermined angle around the axis 39 of the shaft 27. Subsequently, conveying means and positioning means (not shown) are operated so that a cathode-ray tube 11 having a deflection yoke assembly 12 mounted already on its funnel yoke portion is fed into the grasping section constitute by the rollers 37 and 38, and the deflection yoke assembly 12 is positioned at substantially the center of the grasping section, as shown in FIG. 6*d*. Then, as shown in FIG. 6*e*, the motor 25 is driven in the reverse direction to cause counter-clockwise swinging movement of the upper and lower arms 31 and 33 through a predetermined angle around the axis 39 of the shaft 27. Subsequently, as shown in FIG. 6*f*, the piston rod of the cylinder 34 is retracted to cause clockwise swinging movement of the lower arm 33 around the axis 39 of the shaft 27, with the result that the rollers 37 and 38 engage the outer peripheral face of the opening portion 13 of the deflection yoke assembly 12, and the deflection yoke assembly 12 is firmly grasped at its opening portion 13 by these rollers 37 and 38.

Upon grasping of the deflection yoke assembly 12 by the rollers 37 and 38, a predetermined test pattern is displayed on the display screen of the cathode-ray tube 11. The displayed test pattern is picked up by the ITV camera 81 and is converted into an image signal which is applied to the processing circuit 82. In response to the application of the image signal from the ITV camera 81, the processing circuit 82 processes the data provided by the image signal and generates a sequence of instruction signals according to a predetermined sequential order of image display correction. At first, the processing circuit 82 determines the correcting direction of inclination of the display screen when the inclination is detected, and such an instruction signal is applied to the motor 42.

In response to the instruction signal applied from the processing circuit 82, the motor 42 rotates in the instructed direction to cause rotation of the driving roller 38 through the drive shaft 43, so that the driving roller 38 causes corresponding rotation of the deflection yoke assembly 12 (in either direction as shown by the arrow $\theta$ in FIG. 1) around the axis 16 of the deflection yoke assembly 12 thereby correcting the inclination of the display screen of the cathode-ray tube 11.

After carrying out adjustment of focusing by means (not shown) in the above state, the processing circuit 82 determines the directions of convergence alignment and purity adjustment in the central area of the display screen of the cathode-ray tube 11, and such instruction signals are applied to the magnet adjusting device 83. In response to the instruction signals applied from the processing circuit 82, the magnet adjusting device 83 acts to rotate the magnets in the magnet assembly 17 in the instructed directions to attain convergence alignment and purity adjustment in the central area of the display screen of the cathode-ray tube 11. Upon completion of the convergence alignment and purity adjustment above described, the processing circuit 82 applies an instruction signal to the motor 75 for adjusting purity in the peripheral area of the display screen of the cathode-ray tube 11.

In response to the instruction signal applied from the processing circuit 82, the motor 75 rotates in the normal and reverse directions as instructed thereby causing reciprocating sliding movement of the slide base 51 within a predetermined range. Thus, the deflection yoke assembly 12 is urged to slide in the axial direction of the neck portion of the cathode-ray tube 11 (that is, in a direction as shown by the arrow Z in FIG. 1), and the motor 75 ceases to rotate when the deflection yoke assembly 12 is brought to the position which provides the best purity in the peripheral area of the display screen of the cathode-ray tube 11.

Upon completion of the purity adjustment in the peripheral area of the display screen of the cathode-ray tube 11 in the manner above described, the processing circuit 82 determines the direction of convergence alignment in the peripheral area of the display screen of the cathode-ray tube 11 on the basis of the data provided by the test pattern image signal applied from the ITV camera 81, and instruction signals for causing vertical and horizontal oscillating movement of the opening portion 13 of the deflection yoke assembly 12 are applied to the motors 25 and 55 respectively.

In response to the instruction signal applied from the processing circuit 83, the motor 25 rotates in the instructed direction to cause swinging movement of the upper and lower arms 31 and 33 in the required direction around the axis 39 of the horizontal shaft 27 as shown in FIG. 7. Consequently, the opening portion 13 of the deflection yoke assembly 12 is oscillated in the vertical direction (that is, a direction as shown by the arrow Y in FIG. 1).

On the other hand, in response to the instruction signal applied from the processing circuit 82, the motor 55 rotates in the instructed direction to cause turning movement of the turning base 21 in the required direction around the axis 58 of the vertical shaft 59 as shown in FIG. 8. Consequently, the opening portion 13 of the deflection yoke assembly 12 is oscillated in the horizontal direction (that is, in a direction as shown by the arrow X in FIG. 1).

In this manner, the opening portion 13 of the deflection yoke assembly 12 is caused to oscillate in the vertical direction and horizontal direction or in the composite direction of the vertical and horizontal directions, and the motors 25 and 55 cease to rotate when the deflection yoke assembly 12 is brought to the position which provides the best convergence in the peripheral area of the display screen of the cathode-ray tube 11.

Upon completion of all the steps for the screen inclination correction, covergence alignment and purity adjustment above described, clamping means (not shown) are operated to drive a plurality of wedge-shaped members into the gap between the funnel yoke portion of the cathode-ray tube 11 and the opening portion 13 of the deflection yoke assembly 12 and to fasten the fixing member 14 of the fixing portion 18 on the funnel yoke portion of the cathode-ray tube 11 thereby clamping the deflection yoke assembly 12 to the funnel yoke portion of the cathode-ray tube 11.

After the deflection yoke assembly 12 has been clamped to the cathode-ray tube 11, the cylinder 34 is actuated to cause counter-clockwise swinging movement of the lower arm 33 around the axis 39 of the shaft 27, and the rollers 37 supported by the brackets 36 fixed to the lower arm 33 are disengaged or moved away from the deflection yoke assembly 12. Subsequently, the motor 25 is driven to cause clockwise swinging movement of the upper and lower arms 31 and 33 through a required angle around the axis 39 of the shaft 27 with the result that the rollers 37 and 38 supported by the brackets 36 fixed to the upper arm 31 are disengaged or moved away from the deflection yoke assembly 12. Thus, the deflection yoke assembly 12 is completely released from the state grasped by the rollers 37 and 38.

Them the cathode-ray tube 11 having the deflection yoke assembly 12 released from the position grasped by the rollers 37 and 38 is conveyed to the next station by the conveying means.

It will be understood from the foregoing detailed description of the present invention that the deflection yoke assembly 12 can be automatically positioned for the correction of inclination of the display screen of the cathode-ray tube 11 as well as the purity adjustment and convergence alignment of the display screen of the cathode-ray tube 11.

We claim:

1. A device for positioning a deflection yoke assembly on a cathode-ray tube comprising:

(a) first oscillating means comprising grasping means including a plurality of rollers for rotatably grasping the deflection yoke assembly in such a relation that the center of the fixing portion of the deflection yoke assembly is located on a horizontal axis, and causing controlled vertical oscillating movement of the opening portion of the deflection yoke assembly around said center of said fixing portion;

(b) rotating means associated with said first oscillating means for causing controlled rotating movement of the deflection yoke assembly grasped by said first oscillating means around the axis of the deflection yoke assembly;

(c) second oscillating means for supporting said first oscillating means in such a relation that said center of the fixing portion of the deflection yoke assembly grasped by said first oscillating means is located on a vertical axis, and turning said first oscillating means around said vertical axis thereby causing controlled horizontal oscillating movement of the opening portion of the deflection yoke assembly around said center of said fixing portion; and (d) sliding means carrying said second oscillating means thereon for causing controlled sliding movement of said second oscillating means in the axial direction of the neck portion of the cathode-ray tube thereby causing controlled sliding movement of the deflection yoke assembly grasped by said first oscillating means in the axial direction of the neck portion of the cathode-ray tube.

2. A deflection yoke assembly positioning device as claimed in claim 1, wherein said first oscillating means comprises:

(a) a turning base for supporting said first oscillating means supported by said second oscillating means;

(b) a horizontal shaft supported freely rotatably on said turning base with its axis extending in the horizontal direction;

(c) an upper arm extending in a predetermined direction from a first supporting member fixedly mounted on said horizontal shaft;

(d) a lower arm extending in a predetermined direction from a second supporting member freely rotatably mounted on said horizontal shaft;

(e) a plurality of rollers constituting said grasping means, said rollers being freely rotatably supported by said upper and lower arms in such a relation that said center of the fixing portion of the deflection yoke assembly is located on the axis of said horizontal shaft when said rollers engage the outer peripheral face of the opening portion of the deflection yoke assembly to grasp the same;

(f) arm actuating means disposed between said upper and lower arms for moving said upper and lower arms toward and away from each other thereby moving said rollers constituting said grasping means between the grasping position and the releasing position; and (g) drive means disposed on said turning base for rotating said horizontal shaft in a required direction.

3. A deflection yoke assembly positioning device as claimed in claim 1, wherein said rotating means comprises drive means supported by a supporting member fixed to said turning base for rotating at least one of said rollers.

4. A deflection yoke assembly positioning device as claimed in claim 1, wherein said second oscillating means comprises:

(a) a slide base making controlled reciprocating sliding movement in the axial direction of the neck portion of the cathode-ray tube by being urged by said sliding means;

(b) an upstanding shaft fixed to said slide base with its axis extending in the vertical direction;

(c) a vertical shaft supported on said upstanding shaft so as to be freely rotatable around said axis, said vertical shaft supporting said first oscillating means in such a relation that said center of the fixing portion of the deflection yoke assembly grasped by said grasping means in said first oscillating means is located on the axis of said vertical shaft; and (d) drive means for rotating said vertical shaft around the axis of said upstanding shaft thereby causing controlled horizontal oscillating movement of the opening portion of the deflection yoke assembly grasped by said first oscillating means.

* * * * *